US005765265A

United States Patent [19]

Kang

[11] Patent Number: 5,765,265

[45] Date of Patent: Jun. 16, 1998

[54] BELT BUCKLE

[76] Inventor: Koo Seong Kang, 501-707 Jukong Apartments Gaepo Dong, Kang Nam Ku Seoul, Rep. of Korea

[21] Appl. No.: 869,748

[22] Filed: Jun. 5, 1997

[51] Int. Cl.[6] ..... A44B 11/24

[52] U.S. Cl. ..... 24/177; 24/178

[58] Field of Search ..... 24/163 R, 178, 24/177, 188; 2/311, 336, 338

[56] References Cited

U.S. PATENT DOCUMENTS

| | | | |
|---|---|---|---|
| 2,066,398 | 1/1937 | Getts | 24/178 |
| 4,961,250 | 10/1990 | Calavenna | 24/178 |

FOREIGN PATENT DOCUMENTS

| | | | |
|---|---|---|---|
| 1041517 | 10/1953 | France | 24/178 |

*Primary Examiner*—James R. Brittain

*Attorney, Agent, or Firm*—William B. Ritchie

[57] ABSTRACT

A buckle for securing together two ends of a material such as a leather belt. A bail having a cross-bar end is provided. Pivotally secured to the cross-bar is a tongue assembly having a main barrel and an articulating toggle. The toggle can be set into two different positions. When the buckle is closed, the end of the toggle is set into a detente such that the material that has been fed through the belt is minimally bent. When the toggle is set into the second position, the end of the toggle is positioned so that the toggle is substantially perpendicular to the hole end of the material so that the toggle can be easily inserted into one of the toggle holes in the material.

8 Claims, 4 Drawing Sheets

BELT BUCKLE

BACKGROUND OF THE INVENTION

1. Field of the Invention

The invention relates to belt buckles, in particular, belt buckles that have a tongue and a bail.

2. Description of the Related Art

Numerous apparatus are known in the art that are useful for joining together two ends of a length of material such as a leather belt. U.S. Pat. No. 689,119, issued to Pierce on Dec. 17, 1901, discloses a buckle apparatus having a spring-loaded tongue to accomplish a telescoping effect. The function of the telescoping tongue is to allow the tongue to pass through the bail of the buckle so that either side of the belt can be worn.

French Patent No. 832,941, issued to Gouet on May 28, 1937, discloses a buckle design where dual tongues are retracted from a crossbar by raising the face of the buckle away from the wearer to release the belt. The double hinged tongue is pivotally attached to the buckle itself. This invention utilizes a complex and expensive system of springs and levers. Also, any belt used with the invention must have double rows of slots to accommodate the double tongues.

U.S. Pat. No. 7,712, re-issued to Young on May 29, 1877, discloses still another buckle variation. This device features a shoe buckle that is pivotally attached to the material of the boot or shoe. Young teaches that his device eases the insertion of the material into the buckle in those situations where moving the buckle outward is a problem, such as with shoes, or the material is quite inflexible, such as stiff leather, and where bending the piece to be inserted into the buckle is difficult.

There is not found in the prior art, a buckle design where the tongue of the buckle pivots independently of the buckle bail and has an articulating toggle which permits the belt to lie flatter within the buckle and makes it easier to insert the tongue into a belt hole.

SUMMARY OF THE INVENTION

It is an aspect of the invention to provide a belt buckle that has a tongue that pivots independently of the buckle bail.

Another aspect of the invention is to provide a belt buckle that has a tongue that has an articulating toggle.

It is another aspect of the invention to provide a belt buckle that minimizes the deflection or bending of the belt material as the buckle holds the ends of the belt joined together.

It is still another aspect of the invention to provide a belt buckle that permits ease of insertion of the tongue through a belt hole.

Finally, it is an aspect of the invention to provide a belt buckle that achieves the above mentioned features in an attractive and easily constructed design.

The invention is a buckle for joining together two ends of a material. The material has a bail end and a hole end having a plurality of toggle holes along the hole end of the material. A bail having a cross bar end, an indentation end and an opening through which the hole end of the material can pass therethrough, is provided. The bail has a cross bar at the cross bar end and an indentation at the indentation end. The bail is rigidly attached to the bail end of the material. A first tongue assembly pivotally attached to said cross bar of said bail is provided. The first tongue assembly has a curved toggle having a hole insertion end and a pivoting end. The pivoting end of the toggle has a first positioning surface and a second positioning surface. A main barrel is provided. The main barrel has a cross bar opening at one end and a plunger bore opening at the other end. The main barrel is pivotally attached to the cross bar of the bail via the cross bar opening. The toggle is pivotally attached to the main barrel at the plunger bore opening. A plunger is provided. The plunger is slidably held within the bore of the main barrel. When the plunger is selectively urged against the first positioning surface of said toggle, the buckle is in a closed position with the insertion end of said toggle being flush within the indentation of said bail. When the plunger is selectively urged against the second positioning surface of the toggle, the buckle is in a hole end insertion position with the insertion end of the toggle being substantially perpendicular to one of the toggle holes along the hole end of the material that has been fed through the opening in the bail.

DETAILED DESCRIPTION OF THE INVENTION

Figure 1:
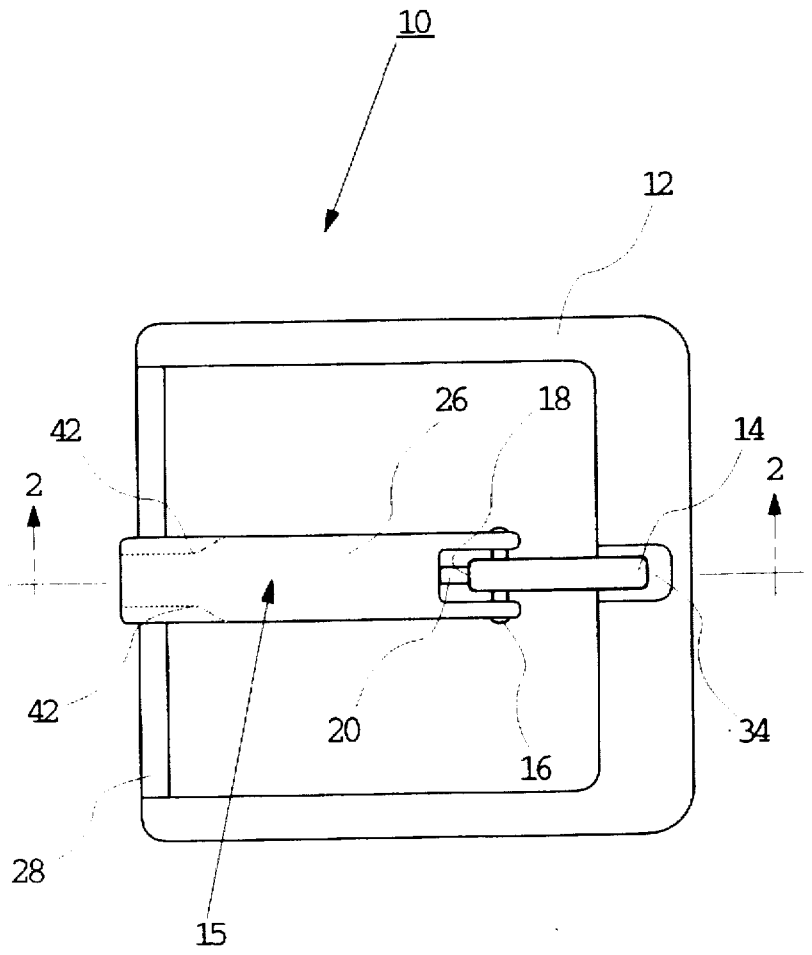
FIG. 1 is a top view of the buckle in accordance with the invention.

Invention 10 is a buckle used to secure material 30 into a closed loop or to join two pieces of material 30 together. The invention 10 is preferably manufactured of metal using an investment casting process for all parts excluding the spring 22. The apparatus could also be made using sand casting and/or machining or a combination, thereof, to form all parts of the invention excluding the spring. The selection of the type of metal to be used would vary according to the application (e.g. stainless steel where corrosion resistance was required). Most metals, both ferrous and nonferrous are suitable for typical applications. Invention 10 is preferably made to be decorative such as plating the buckle with chrome or gold. Non-metallic materials including, but not limited to, plastics and composite materials could be used to meet varying application requirements (e.g. carbon fiber reinforcement where low weight and high strength are required) for all parts excluding the spring 22. Plastic would also be used for situations where cost is most important and appearance is not as important. Spring 22 is preferably manufactured of steel or stainless steel spring wire by the traditional winding process. In place of spring 22, an elastomeric cylinder, using materials known in the art, could be used to urge plunger 20 against toggle 14. Material 30 can be leather, plastic, webbing or any material that is suitable for use as belt material.

A rectangular-shaped bail 12 is provided. At one end of bail 12 is cross pin 28 upon which tongue assembly 15 is rotatably affixed. Cross pin 28 can be made integral with bail 12 or it could be manufactured separately and attached using techniques well known in the art. Bail 12 is provided with indentation 34 which enables the end of curved toggle 14 of the tongue assembly 15 to be seated flush when invention 10 is in the closed position. Cross pin 28 is preferably round. Bail 12 is curved at radius $R_1$ so that horizontal plane B through cross pin 28 is offset by distance 36 from horizontal plane A through indentation 34. In this manner, the bending of material 30 is kept to a minimum as shown in FIG. 2.

Offset distance 36 is set to correspond to the thickness of the material 30 being secured. Bending of belt material 30 is further minimized by curving toggle 14 via radius $R_2$ of the tongue assembly 15 as it passes through belt opening 32. The pivoting ability of the toggle 14 relative to the main barrel 26 of tongue assembly 15 enables the curved toggle 14 to be pivoted to a position where the end of toggle 14 is substantially perpendicular relative to belt 30 prior to attempting to insert toggle 14 through one of belt holes 32. This facilitates the insertion of toggle 14 through belt opening 32 in material 30.

The design 14 also assists in releasing the invention 10 when it is desired to open the buckle. By slightly pulling the end of belt 30 outward and backward, tongue assembly 15 pivots, thus, causing toggle 14 to disengage from opening 32.

Figure 2:
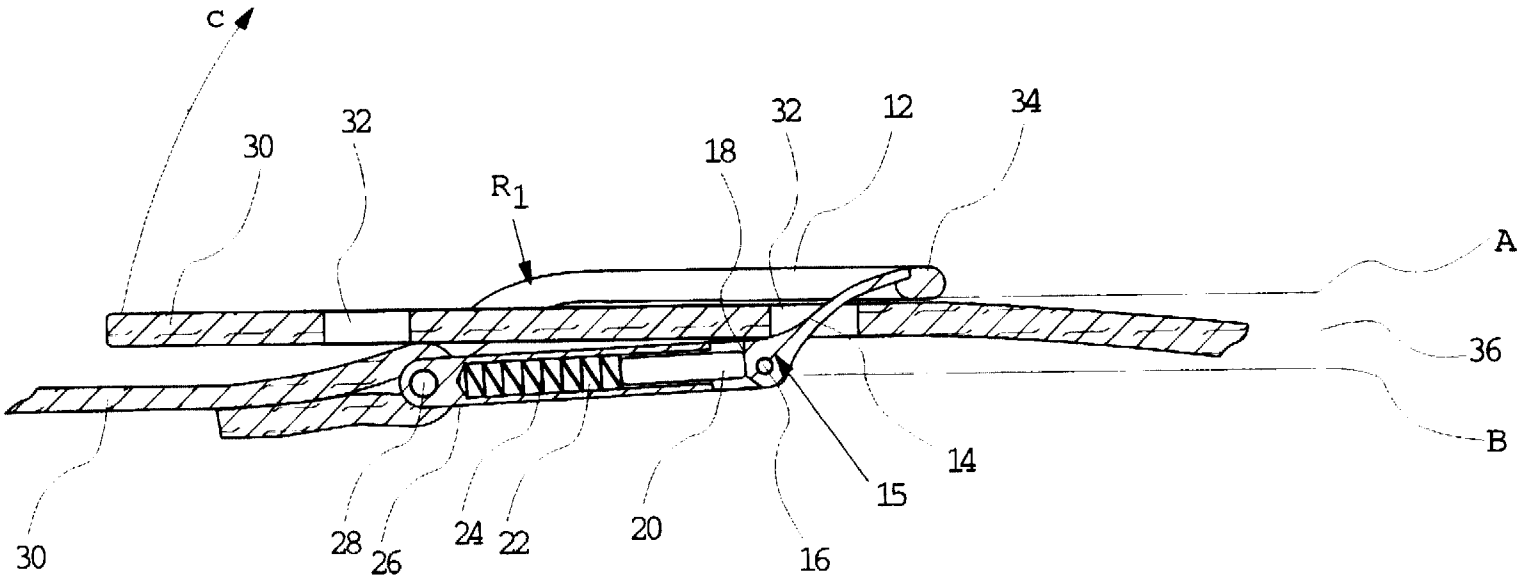
FIG. 2 is a sectional view across section lines 2—2 as shown in FIG. 1.

Referring now to FIG. 2, invention 10 is shown in the closed position holding belt 30 in a loop. One end of belt 30 is wrapped around cross pin 28 and secured to the belt using techniques well known in the art. A hole (not shown) must be provided in that portion of the belt 30 that wraps around cross bar 28 so that the tongue assembly 15, which is attached to cross bar 28, can extend therethrough. In order to allow the size of this hole to be minimized, main barrel 26 can be tapered at the dotted lines 42 (shown in FIG. 1), if desired.

Figure 3:
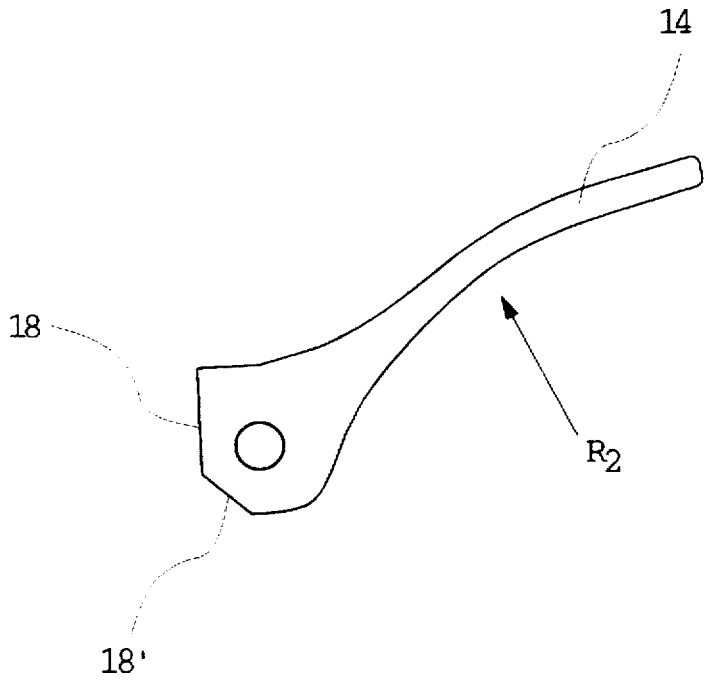
FIG. 3 is a detailed side view of the curved toggle of the tongue assembly showing the planar surfaces which are used to provide the two positions of the curved toggle of the tongue.

Tongue assembly 15 has two major component parts, toggle 14 and main barrel 26. The preferred shape of toggle 14 is shown in FIG. 3. Toggle 14 is attached to barrel 26 via pin 16. Bore 24 is provided within main barrel 26 into which compression spring 22 and plunger 20 is inserted. One end of plunger 20 engages either surface 18 or surface 18' on toggle 14.

As shown in FIG. 2, plunger 20 is engaging surface 18 which provides the closed position of invention 10. In this position, the insertion end of toggle 14 rests in indentation 34, that is, above or immediately adjacent to plane A. In this manner, belt 30 undergoes only little deflection, thus keeping belt 30 substantially in the same plane even when passing through the buckle.

When plunger 20 engages surface 18' of toggle 14, the insertion end of toggle 14 is positioned below plane B so that when belt 30 is fed through bail 12, the insertion end of toggle 14 is aligned substantially perpendicular to belt 30, thus facilitating the entry of toggle 14 into one of belt holes 32.

By gently pulling belt 30 in direction C, bail 12 is pulled away from toggle 14 and toggle 14 is free to pivot away from belt 30 causing the buckle to easily release.

Figure 4:
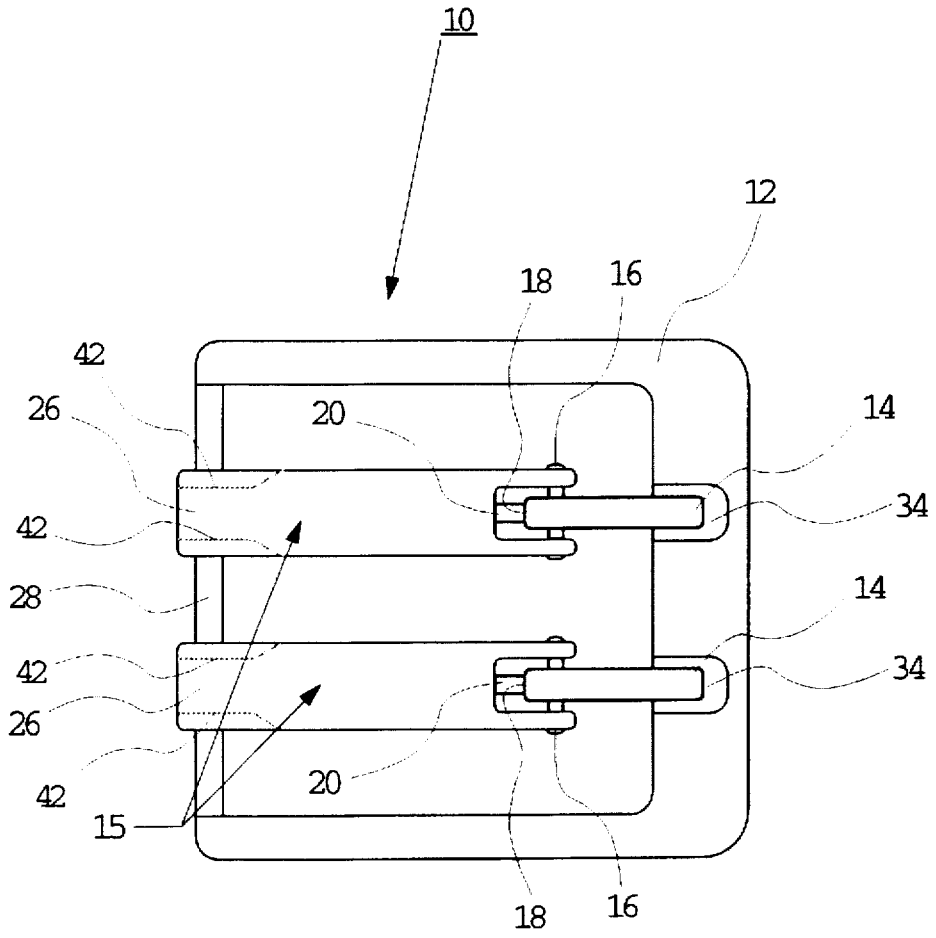
FIG. 4 is a top view of an alternative embodiment of the belt buckle showing a double tongue assembly.

An alternative embodiment of invention 10 utilizes two tongue assemblies 15 as shown in FIG. 4. In this embodiment, two identical tongue assemblies 15 are located on cross bar 28. All other aspects of invention 10 are the same as previously described.

While there have been described what are preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A buckle for joining together two ends of a material having a bail end and a hole end having a plurality of toggle holes along the hole end of the material, said buckle comprising:

a bail having a cross bar end, an indentation end and opening through which the hole end of the material can pass therethrough, said bail further comprising a cross bar at the cross bar end and an indentation at the indentation end, said bail being rigidly attached to the bail end of the material;

a first tongue assembly pivotally attached to said cross bar of said bail, said first tongue assembly further comprising:

a curved toggle having a hole insertion end and a pivoting end, the pivoting end of said toggle having a first positioning surface and a second positioning surface, a main barrel having a cross bar opening at one end and a plunger bore opening at the other end, wherein said main barrel is pivotally attached to said cross bar of said bail via the cross bar opening, and wherein said toggle is pivotally attached to said main barrel at the plunger bore opening, a plunger, slidably held within the bore of said main barrel, such that when said plunger is selectively urged against the first positioning surface of said toggle, said buckle is in a closed position with the insertion end of said toggle being flush within the indentation of said bail and such that when said plunger is selectively urged against the second positioning surface of said toggle, said buckle is in a hole end insertion position with the insertion end of the toggle being substantially perpendicular to one of the toggle holes along the hole end of the material that has been fed through the opening in said bail.

2. The buckle of claim 1 wherein said bail further comprises a curved section having a predetermined radius and a substantially non-curved section.

3. The buckle of claim 2 wherein the curved section of said bail is adjacent to the cross bar end.

4. The buckle of claim 3 wherein a first plane is defined by the non-curved section of said bail and a second plane, being substantially parallel to said first plane, which is defined by the main barrel of said first tongue assembly such that when said buckle is in the closed position, a distance that is measured between the two planes corresponds to the thickness of the material at the hole end.

5. The buckle of claim 1 further comprising a spring positioned within the bore of said main barrel, wherein said spring urges said plunger against one of the positioning surfaces of said toggle.

6. The buckle of claim 1 further comprising an elastomeric cylinder positioned within the bore of said main barrel wherein said elastomeric cylinder urges said plunger against one of the positioning surfaces of said toggle.

7. The buckle of claim 1 wherein said curved toggle further comprising a curve having a predetermined radius adjacent to the hole insertion end, such that, when said buckle is in the hole insertion position, the substantially perpendicular positioning of said toggle relative to the material at the hole end is provided.

8. The buckle of claim 1 further comprising a second toggle assembly that is substantially identical to said first toggle assembly.

* * * * *